United States Patent [19]

Chen

[11] 4,454,653

[45] Jun. 19, 1984

[54] BARBER-TYPE RAZOR

[75] Inventor: Evan N. Chen, Fairfield, Conn.

[73] Assignee: Warner-Lambert Company, Morris Plains, N.J.

[21] Appl. No.: 342,533

[22] Filed: Jan. 25, 1982

[51] Int. Cl.[3] ..... B26B 21/10

[52] U.S. Cl. ..... 30/53; 30/40.2

[58] Field of Search ..... 30/40, 40.2, 53

[56] References Cited

U.S. PATENT DOCUMENTS

| | | | |
|---|---|---|---|
| 2,650,421 | 9/1953 | Wietzel | 30/53 X |
| 3,728,788 | 4/1973 | Pearson | 30/40.2 X |
| 3,772,778 | 11/1973 | Ishida | 30/53 |
| 3,983,627 | 10/1976 | Montrasi | 30/53 |
| 4,285,125 | 8/1981 | Chen | 30/53 |

FOREIGN PATENT DOCUMENTS

| | | | |
|---|---|---|---|
| 52-34858 | 3/1977 | Japan | 30/40.2 |

*Primary Examiner*—Jimmy C. Peters
*Attorney, Agent, or Firm*—R. S. Strickler

[57] ABSTRACT

A barber-type razor of the class adapted to receive a new blade from a cooperating blade ejector device including a novel blade guide latch and used blade ejector device.

2 Claims, 13 Drawing Figures

BARBER-TYPE RAZOR

BACKGROUND OF THE INVENTION

This invention relates to barber razors and relates in particular to barber razors adapted to receive new blades from a new blade ejector device.

PRIOR ART

Prior art razors of this class over which the present invention is an improvement are disclosed and described in U.S. Pat. Nos. 3,772,778 issued to Ishida et al. on Nov. 20, 1973, and 4,285,125 issued to Chen et al. on Aug. 25, 1981.

The '778 patent shows a pair of hinged blade guides 23 and 23' which pivot about tubular members 12 and 13. A set screw *3b* secures the guides and blocks axial relative motion. A jamming wedge 18 is also provided to pinch the blade within the guides in opposition to leaf spring 5.

The '125 disclosure is similar, its distinguishing feature being a leaf spring 28 disposed above the hinge axis which operates to retain the blade guides in a blade retaining position. In addition, the spring 28 is formed with a knee which engages a blade guide notch 32 effective to preclude inadvertent relative motion between blade guides along the axis of the guide pivot.

SUMMARY OF THE INVENTION

Among the features of the present invention is the provision of a razor of the above general class which is provided with a used blade ejector means.

A further feature is the provision of a simple, manually operable latch means for precluding relative motion between blade guides along a path parallel to the razor hinge axis.

A razor embracing certain features of the present invention may comprise a first blade guide terminating in a handle, a second blade guide hinged to said first blade guide by means of axle or spindle means defining a single axis, said spindle means and its axis being disposed in a generally medial position relative to said guides to define within said guides an upper operating section and a lower clamping section, lock means for clamping said guides, said blade guides being formed with an ejector socket for receiving a new blade, ejector means for depositing a new blade into said clamping section, said means defining a jamming wedge carried by and movable along said spindle means effective to pivot said one guide relative to said other guide to clamp said blade and used blade ejector means mounted on said spindle means and movable therealong operative to eject a spent blade from said guides.

Other features and advantages of the present invention will become more apparent from an examination of the following specification when read in conjunction with the appended drawings, in which:

DESCRIPTION OF PREFERRED EMBODIMENT

Figure 1:
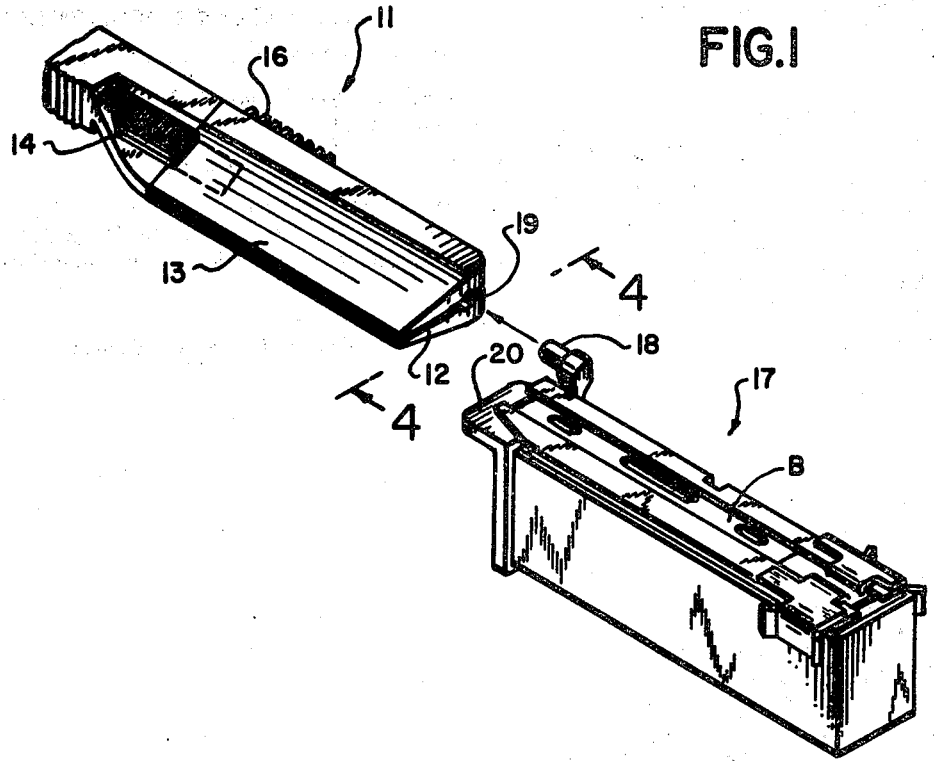
FIG. 1 is a perspective view of the razor of the present invention showing a blade ejector cartridge poised for entry into and connection with the razor ejector cartridge socket.

Referring now in detail to the drawings, the reference numeral 11 shows the right end of a barber razor comprising a first blade guide 12, second blade guide 13, used blade ejector button 14 and blade guide jamming wedge 16.

As is apparent in FIG. 1, a classic blade injector cartridge 17 is poised to make a "bayonet-like" connection with the right end of the razor 11 in that pin 18 is operable to be received in socket or opening 19 while ejector lip 20 underlays and contacts the outside of the first blade guide 12. This connection is shown most clearly in FIG. 2.

Figure 2:
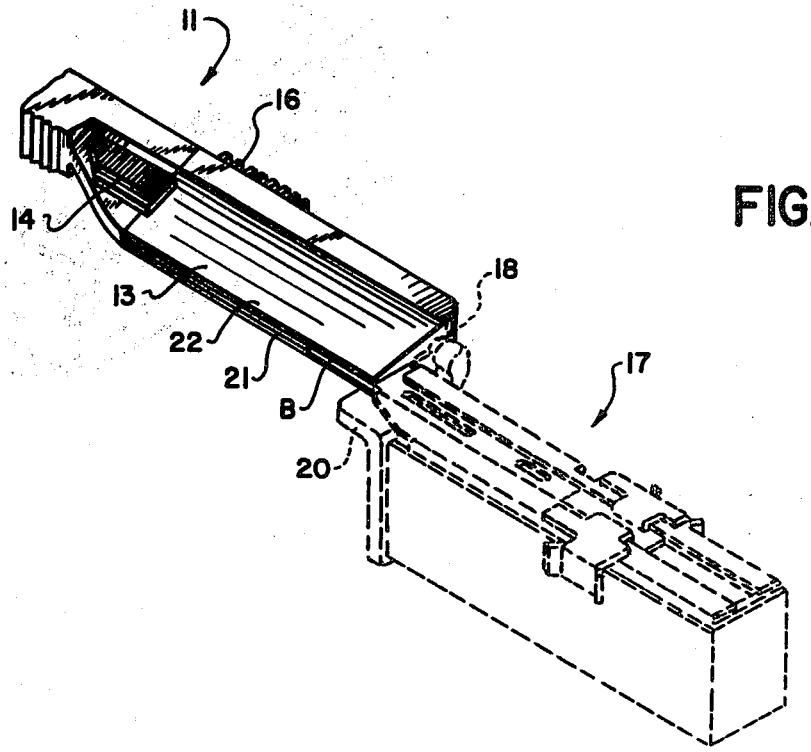
FIG. 2 is a view similar to FIG. 1 showing the blade ejector cartridge in phantom, in place in the razor socket with a new blade partially inserted between blade guides.
Figure 3:
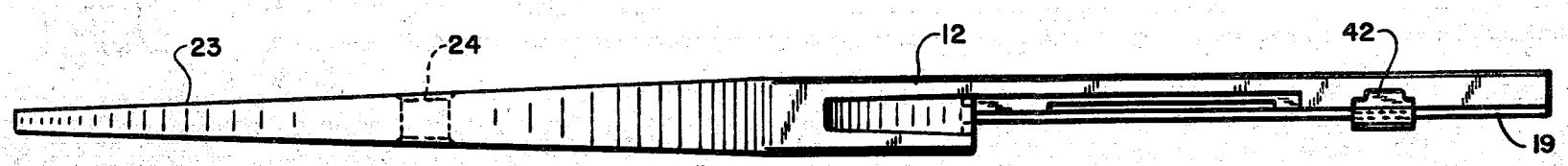
FIG. 3 is a top plan view of the first blade guide which terminates in a handle.
Figure 4:
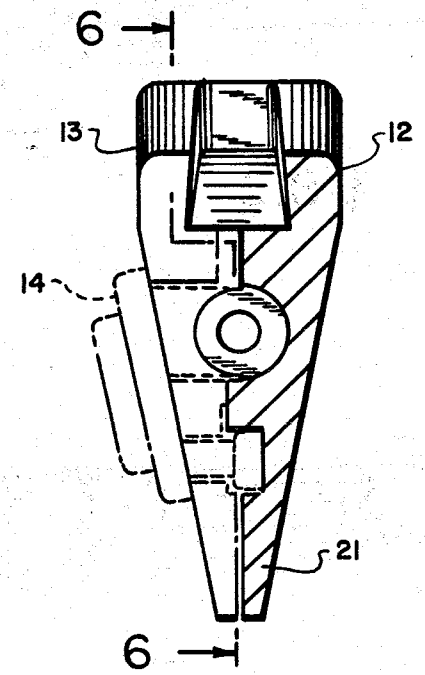
FIG. 4 is an elevational view, partially in section, of the right end of the assembled razor as viewed in the direction of the arrows 4—4 in FIG. 1.
Figure 5:
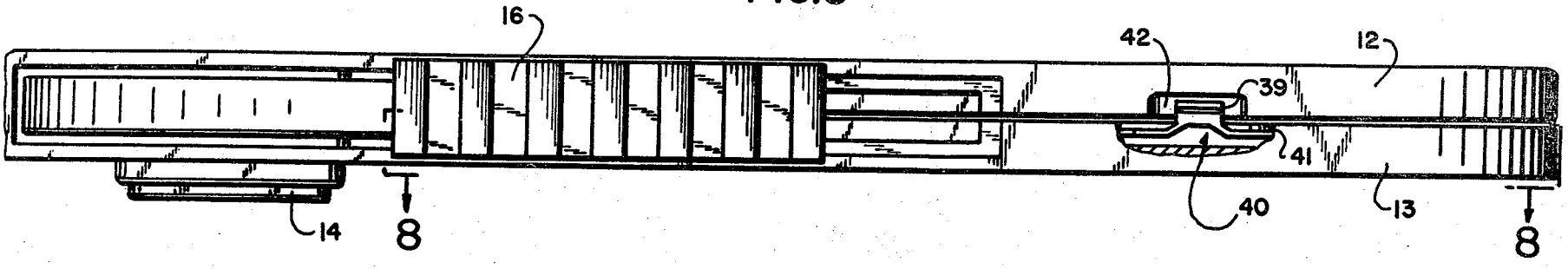
FIG. 5 is a top plan view of the assembled razor with the handle broken away.

FIG. 2 also shows the jamming wedge 16 in the retracted position thus freeing the clamping lips 21 and 22 of guides 12 and 13 to receive a new blade B. Preferably the lips 21 and 22 are chamfered slightly at the right end as viewed in FIGS. 1 and 2 to facilitate entry of the new blade.

After new blade B is received with the lips of the blade guides the jamming wedge 16 is advanced to the right effective to clamp the new blade within the blade guide lips 21 and 22 in a manner which will become more apparent as this specification proceeds.

FIGS. 3 through 8 show first blade guide 12 terminating in tail 23 having a bore 24 for hinging a wood or plastic handle (not shown) in well-known fashion.

The second blade guide 13 is hinged to the first guide 12 by spindle means defining an elongated pin 26 making a press fit into sleeve 27 and short pin 28 making a press fit into sleeve 29. Both pins 26 and 28 are supported and fixed to blade guide 13 as is most apparent in FIG. 8.

Figure 6:
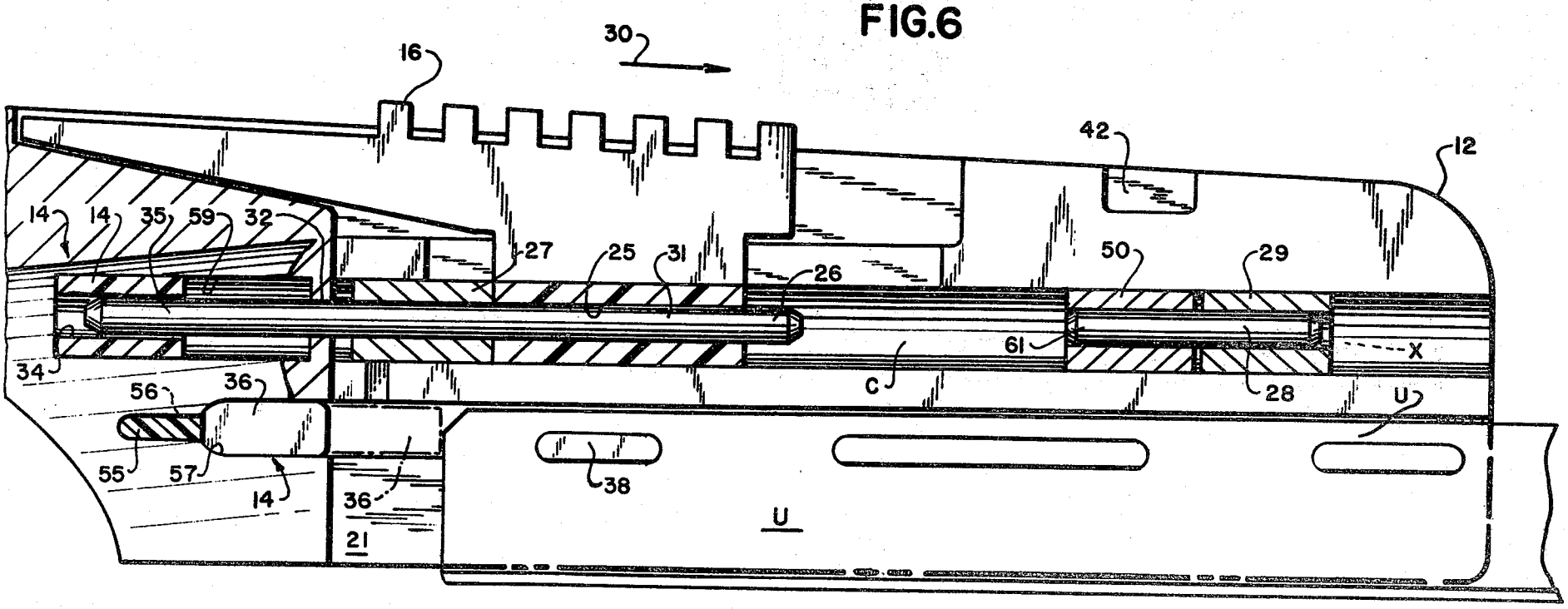
FIG. 6 is a sectional view of FIG. 4 sectioned along the line labeled 6—6 and viewed in the direction of the arrows.

As shown in FIG. 6, the jamming wedge 16, formed with a bore 25, is carried by and slidable along the forward end 31 of elongated pin 26; the rear end 35 of the pin 26 carries ejector button 14. The pin 26, in assembly, is received and slidably supported in a bore 32 formed in the first guide 12.

Clearance C (FIG. 6) is provided to facilitate mounting the wedge 16 on the pin 26 in a manner which will be treated in greater detail when the razor assembly steps are described.

Figure 11:
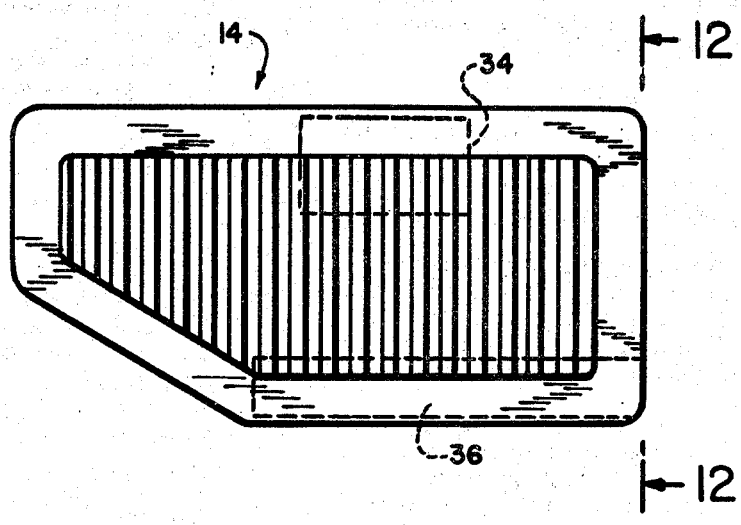
FIG. 11 is a side view of the used blade ejector.
Figure 12:
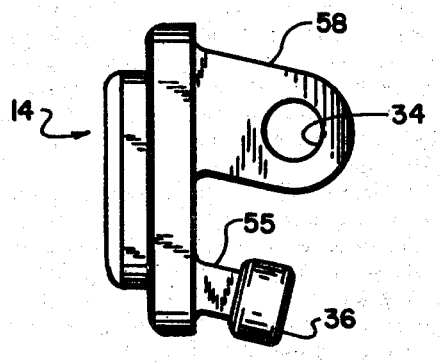
FIG. 12 is a view of the right end of FIG. 11 as observed in the direction of the arrows 12—12.

Ejector button 14 (see FIGS. 11 & 12), formed with a bore 34 and an ejector lug 36, is slidably supported on left end 35 of elongated pin 26 and the lug 36 rides in a slot 38 formed in the lip 21 of blade guide 12.

In assembly the button 14 is movable to the right, as viewed in FIGS. 1, 2, 5 and 6, advancing lug 36 along slot 38 to the dotted line position of FIG. 6. The lug 36 in turn drives a used blade U to the dotted line position of FIG. 6 where it can be grasped and removed entirely for disposal.

Figure 8:
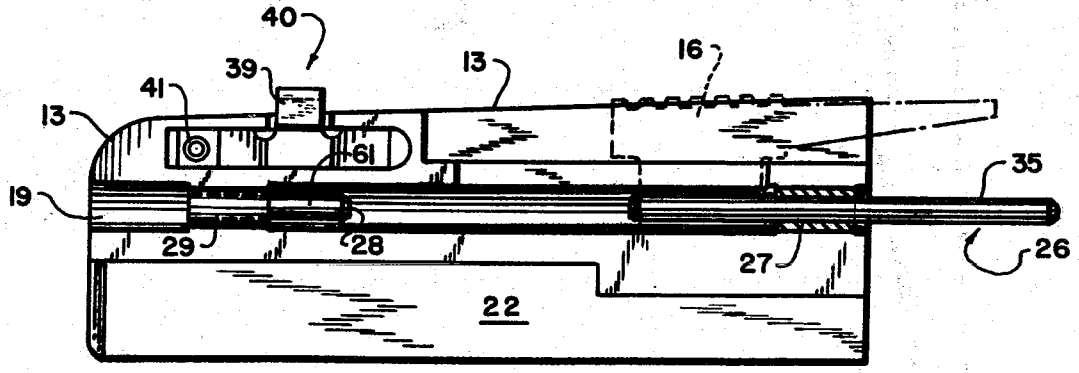
FIG. 8 is a side elevational view of the second blade guide as viewed in the direction of the arrows 8—8 of FIG. 5.
Figure 9:
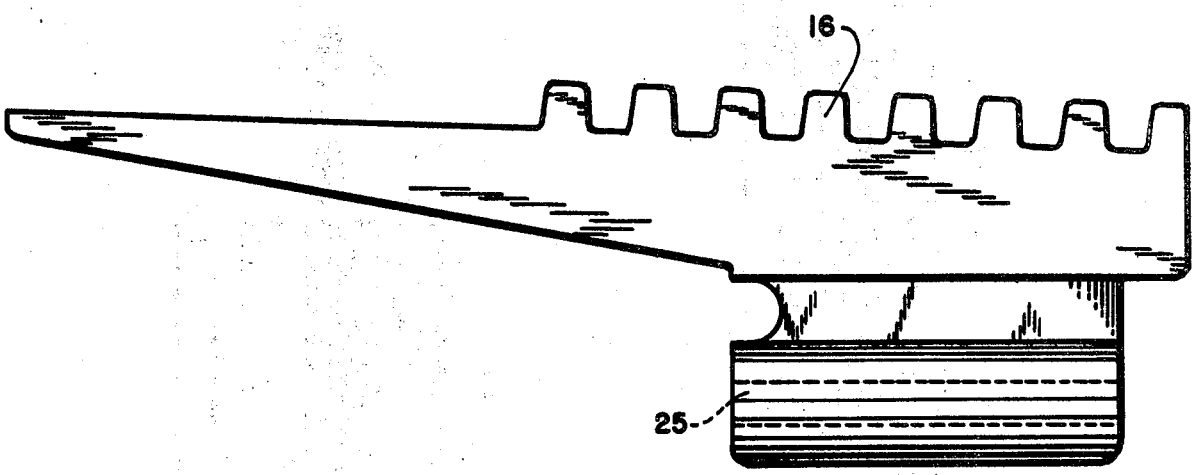
FIG. 9 is a side view in elevation of the jamming wedge.

As is most apparent in FIG. 8, the second blade guide 13 is fitted with latch means indicated generally at 40 for precluding relative motion of the blade guide axially along the razor hinge line or hinge axis when the razor is in the operating condition.

Figure 10:
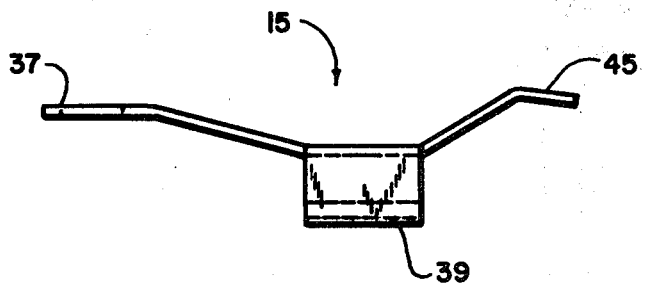
FIG. 10 is a top view of the spring clip.

The latch means defines a leaf spring 15 (see FIG. 10) having opposed wings 37 and 45 with an intermediate offset operating tab 39. The spring 15, secured to the second guide 13 by rivet 41, is biased such that upon assembly of the blade guides the tab 39 engages a mating notch 42 formed in the first blade guide 12 to lock the guides against relative axial motion.

Manual manipulation of the tab 39 out of the notch 42 unlocks the blade guides and permits relative axial motion of the blade guides to disassemble the razor in a manner which will be more apparent hereinafter.

The wedge 16 is formed with a jamming taper which mates with a cooperating taper formed in the blade guides such that, upon introduction of a blade within the blade guides from the blade injector cartridge, advance of the wedge 16 along the pin 26 in the direction of the arrow 30 of FIG. 6 into the clearance space C will spread the top portion of the guides causing clamping action of the lips 21 and 22 below the hinge axis to retain blade B. This action is similar to the wedge action in the disclosure of the '778 patent.

The "take down" (disassembly) and assembly of the razor occurs in the following fashion.

Assume that a blade is secure in the razor with the wedge 16 to the right in the jammed position.

If the wedge 16 is moved to the left as viewed in FIG. 6, the blade clamping action is released.

Next the ejector button 14 is moved to the right causing a spent blade U to be ejected to the dotted line position where it can be grasped and removed for disposal.

Thereafter tab 39 is moved against spring bias out of notch 42 while an axial force is applied to the second blade guide 13.

This action causes the left end 35 of pin 26 to withdraw from bore 32. Correspondingly pin 28 pulls out of sleeve 50 (see FIG. 6) to release guide 13 from guide 12.

Note that in this separation of guides the jamming wedge 16 is carried along and remains supported by second guide 13.

Next wedge 16 is moved off end 31 of pin 26 into clearance area C thus freeing and separating the wedge from blade guide 13.

Finally ejector button 14 is moved to the right moving neck 55 out of track 56 to enlarged area 57 (see FIGS. 6, 7 and 12) whereupon the button 14 is lifted free of the guide 12.

To assemble the razor, button 14 is positioned relative to the guide 12 so that the boss 58 is aligned with clearance slot 59 and lugs 36 is in register with enlarged area 57 of guide 12 so that boss 58 moves readily into slot 59 and lug 36 enters enlarged area 57.

Thereafter button 14 is moved to left (FIG. 6) so that neck 55 engages track 56 to retain button 14 in guide 12.

Next wedge 16 is mounted upon forward end 31 of pin 26 carried by guide 13 to assume the position shown in dotted lines in FIG. 8.

With the piece-parts in the described positions, the end 35 of pin 26 and the end 61 of pin 28 are inserted into bores 32 and 50 respectively of guide 12. The guide 13 is moved to the left relative to guide 12 so that end 35 of pin 26 engages bores 34 of button 14 and the tab 39 of latch 15 engages notch 42 to complete the assembly.

Figure 7:
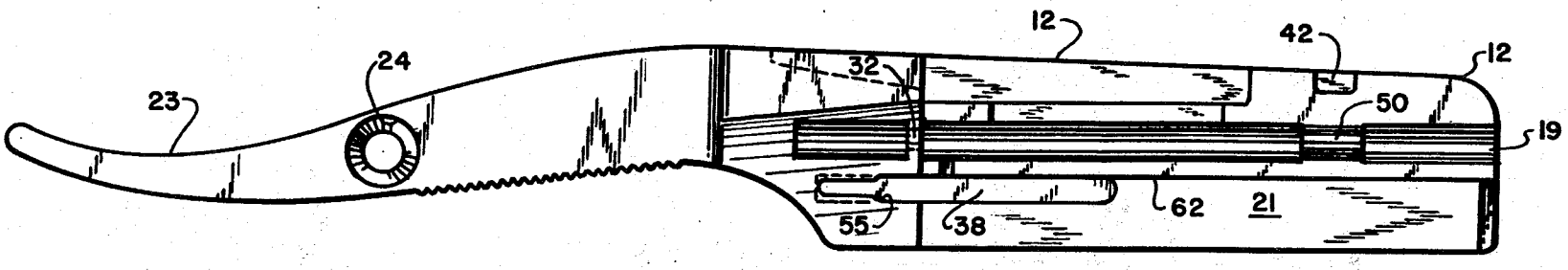
FIG. 7 is a side view of FIG. 3 in elevation.

Thereafter a bayonet connection between the cartridge 17 and the socket 19 permits introduction of a new blade between clamping lips 21 and 22 guided by shoulder 62 (FIG. 7).

After placement of the new blade, the wedge 16 is jammed to the right to clamp the blade in operative position.

Figure 11A:
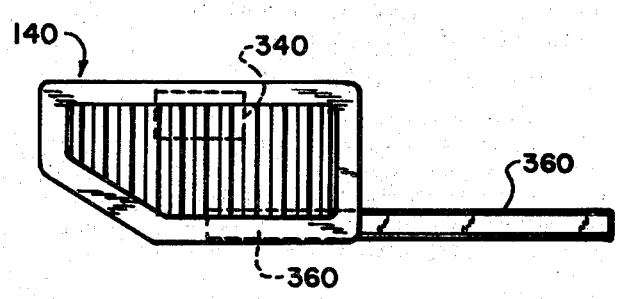
FIG. 11A is a modified blade ejector used to eject short blades.

In FIG. 11A an alternative ejector button 140 includes a bore 340 and an elongated ejector lug 360. The structure and operation of this button is similar to the button 14; the chief difference is the length of ejector lug 360 which is useful to eject short blades.

It is to be particularly noted that a single axis X (FIG. 6) spans the working body of the razor. This construction facilitates alignment of the button 14, the wedge 16 and the blade guide hinge along single axis X. Furthermore it is to be noted that the disclosed structure further facilitates guided axial motion of the ejector button 14 and the jamming wedge 16 along the same axis and further facilitates relative axial motion of the blade guides 12 and 13 along the axis X upon assembly and disassembly of the razor unit.

The axis X serves further to divide each blade guide 12 and 13 into two sections; the portion of each guide above the axis being the operating section and the portion below the axis being the clamping section.

What is claimed is:

1. A barber razor having a pair of hinged blade guides including lock means for actuating the guides to clamp a blade, the improvement comprising:

a first blade guide terminating in a handle, a second blade guide hinged to said first blade guide by means of axle or spindle means defining a single axis, said second blade guide being movable relative to said first blade guide along said axis, latch means defining a spring clip having a manual operating tab mounted upon said second guide cooperating with a notch formed in said first guide, said spindle means and its axis being disposed in a generally medial position relative to said guides to define within said guides an upper operating section and a lower clamping section, said blade guides being formed with an injector socket for receiving a new blade, injector means for depositing a new blade into said clamping section, said lock means defining a jamming wedge carried by and movable along said spindle means effective to pivot said second guide relative to said first guide to clamp said blade and used blade ejector means mounted on said spindle means and movable therealong operative to eject a spent blade from said guides.

2. A barber razor having a pair of hinged blade guides including lock means for actuating the guides to clamp a blade, the improvement comprising:

a first guide terminating in a handle, a second blade guide hinged to said first blade guide by means of axle or spindle means defining a single axis, said second blade guide being movable relative to said first blade guide along said axis, latch means defining a spring clip having a manual operating tab mounted on one of said guides cooperating with a notch formed on the other of said guides, said spindle means and its axis being disposed in a generally medial position relative to said guides to define within said guides an upper operating section and a lower clamping section, said blade guides being formed with an injector socket for receiving a new blade, and injector means for depositing a new blade into said clamping section, said lock means defining a jamming wedge carried by and movable along said spindle means effective to pivot said second guide relative to said first guide to clamp said blade.

* * * * *